United States Patent [19]

Courtois et al.

[11] Patent Number: 4,846,433

[45] Date of Patent: Jul. 11, 1989

[54] ADJUSTABLE HANGER

[75] Inventors: Peter D. Courtois, Centerville; Roy L. Edgar, Springboro, both of Ohio

[73] Assignee: Dayton Superior Corporation, Miamisburg, Ohio

[21] Appl. No.: 217,109

[22] Filed: Jul. 11, 1988

Related U.S. Application Data

[63] Continuation of Ser. No. 7,056, Jan. 27, 1987, abandoned.

[51] Int. Cl.[4] ..... E04G 17/16

[52] U.S. Cl. ..... 248/235; 248/228; 248/327; 249/23; 249/205; 249/211

[58] Field of Search ..... 248/235, 228, 72, 327; 249/23, 205, 211

[56] References Cited

U.S. PATENT DOCUMENTS

| | | | |
|---|---|---|---|
| 1,535,256 | 4/1925 | Saunier | 249/211 |
| 1,652,695 | 12/1927 | Barber | 248/72 |
| 2,985,937 | 5/1961 | Hillberg | 249/211 X |
| 3,136,521 | 6/1964 | Corcoran | 248/300 |
| 3,626,648 | 12/1971 | Beckham | 249/23 X |
| 3,782,676 | 1/1974 | Boll et al. | 249/23 |
| 3,961,765 | 6/1976 | Brothers | 248/235 X |
| 3,981,469 | 9/1976 | Torbet et al. | 249/23 X |
| 3,993,279 | 11/1976 | Holt | 249/23 X |
| 4,062,519 | 12/1977 | Jacobs | 248/228 X |
| 4,244,545 | 1/1981 | Berry | 248/228 X |
| 4,254,932 | 3/1981 | Durbin | 249/25 X |

FOREIGN PATENT DOCUMENTS 1434346 11/1968 Fed. Rep. of Germany ..... 248/351

*Primary Examiner*—Alvin C. Chin-Shue

*Attorney, Agent, or Firm*—Biebel, French & Nauman

[57] ABSTRACT

An adjustable hanger for supporting a concrete form which includes a first bracket having a downwardly-extending portion for engaging an edge of an I beam flange, a second bracket for engaging an I beam flange, and a threaded rod screwed into and extending between the first and second brackets so that the second bracket can be adjusted in spacing from the first bracket to enable the hanger to accommodate a variety of I beam flange widths. In the preferred embodiment, the second bracket includes an upwardly extending portion having a wedge-shaped slot and an outer arcuate bearing surface. The upwardly extending portion receives a bolt for supporting cantilevered formwork and the bolt is retained within the slot by a nut which rests against the arcuate bearing surface. The retained bolt can be pivoted throughout a range of angular orientations relative to the second bracket as the circumstances of use may require. The first and second brackets each include a through bore for receiving additional formwork supporting bolts that are oriented substantially perpendicularly to the threaded connecting rod.

2 Claims, 2 Drawing Sheets

ADJUSTABLE HANGER

REFERENCE TO RELATED APPLICATION

This is a continuation of application Ser. No. 0007,056, filed Jan. 27, 1987, and now abandoned.

BACKGROUND OF THE INVENTION

The present invention relates to hangers for supporting concrete formwork and, more particularly, to hangers for supporting concrete formwork associated with I beams and including cantilevered sections.

In the design of bridges, it is common to provide a sidewalk, fascia or similar auxiliary concrete structure to extend along and adjoin the principal concrete roadway, overpass or other concrete installation. Typically, such auxiliary structures are located outside the I beams comprising the bridge superstructure. Consequently, it is necessary to provide formwork which is supported by these outside I beams and, in turn, supports formwork which is cantilevered outwardly from these I beams.

For example, the Boll et al. U.S. Pat. No. 3,782,676 discloses a formwork hanger which is specially designed to support formwork that is cantilevered outwardly from an I beam. The hanger includes an inboard bracket having a downwardly extending portion that engages the inside edge of the upper I beam flange, an outside bracket that rests upon the upper surface of the I beam flange, and a connecting rod which joins the brackets togther and spaces them at a predetermined distance appropriate for a specific flange width. Both of the brackets are U-shaped, and the inside bracket includes a vertically extending channel which is shaped to receive a formwork support bolt in a substantially vertical orientation. The hanger also includes a third bracket, attached to the connecting rod by an L-shaped bar and positioned adjacent to the outside bracket, which includes a vertical passage for supporting a formwork support bolt in a substantially vertical orientation.

The outside bracket includes a through bore that is disposed at approximately a 45° angle to the supporting I beam flange and is sized to receive a relatively long formwork support bolt. The angled formwork support bolt is attached at its lower end to a triangular member which abuts the vertical web of the I beam and extends horizontally outwardly therefrom to support the formwork that is cantilevered beyond the superstructure.

Another type of hanger is disclosed in the Torbet et al. U.S. Pat. No. 3,981,469. That hanger includes a pair of identically-shaped brackets spaced apart by an upper threaded rod which absorbs tension forces in use and a lower rod which butts the two brackets to absorb compression forces in use. Each connecting bracket has an inverted L-shape which includes an upper overhanging portion having a bore for supporting a vertically oriented formwork support bolt. In addition, each bracket includes an angled section located at the juncture of the vertical and horizontal components of the J-shape and having a slot for receiving a formwork support bolt at approximately a 45° angle.

A disadvantage with both of these types of hangers is that they lack the adjustability which would enable them to be used with more than one width of I beam flange. In the Boll et al. device, there is no mechanism whatsoever for adjusting the spacing between the inside and outside brackets, so that each hanger must be designed specifically for a particular I beam flange width. With the Torbet et al. device, it might be possible to substitute connecting rods of different lengths to vary the spacing between the inside and outside brackets of that device, but such an adjustment is not disclosed in the patent.

A second disadvantage of such devices is that both lack a mechanism for adjusting the angular orientation of the longer support bolts held by the hanger. In some formwork support structure applications, for example, it may be perferable to provide a longer support bolt at angle other than 45°. In such an event, neither of the aforementioned hanger constructions would be useful.

Accordingly, there is a need for a formwork support hanger in which the inside and outside brackets can be adjusted to vary the space between them to accommodate a variety of I beam flange widths, so that a single hanger design can be used in virtually any application. Furthermore, there is a need for a formwork support hanger in which the outside bracket is capable of supporting a formwork support bolt at angles other than 45°.

SUMMARY OF THE INVENTION

The present invention provides an adjustable hanger for supporting concrete formwork which is specially designed to support formwork cantilevered outside of an I beam, and is sufficiently adjustable to be used in virtually any design requiring such formwork. The adjustable hanger includes a first bracket for engaging an I beam flange and having a vertical through bore for receiving a formwork support bolt, a second bracket shaped to rest upon an I beam flange and also having a vertical through bore for receiving a formwork support bolt, and a threaded rod attached into the first bracket and adjustably screwed into the second bracket so that the spacing between the brackets can be varied to accommodate a variety of I beam flange widths. The advantage of the threaded engagement between the connecting rod and the second bracket is that the connection provides both an adjustable and a positive engagement between the rod and bracket which is capable of bearing both tension and compressive loads.

In the preferred embodiment, the first bracket is positioned on the inside portion of the I beam flange and includes a downwardly extending portion which engages the inside edge of the flange. This downwardly extending portion transfers to the I beam flange any lateral construction loads during the casting of concrete which would tend to pull the hanger horizontally outwardly relative to the I beam. The second bracket has a substantially flat bottom and rests upon the top of the I beam flange. The presence of a formwork support bolt in the vertical through bore of the second bracket prevents inward movement of the hanger relative to the I beam.

The rod is preferably threaded along its entire length, and the first bracket preferably includes a threaded bore for receiving one end of the rod. As a result, no special orientation of the rod is required relative to the bracket, thereby facilitating assembly.

Also in the preferred embodiment, the second bracket includes an upwardly-extending portion having a wedge-shaped slot with an arcuate outer bearing surface. The wedge-shaped slot is shaped to receive a formwork support bolt which is retained within the slot by a nut that bears against the arcuate bearing surface. The slot is shaped such that the support bolt it receives can be disposed at a plurality of angles relative to the second bracket, and the arcuate bearing surface ensures that the nut retaining the bolt within the slot is adequateley supported at any selected angular orientation.

In the preferred embodiment, the second bracket is shaped such that the upwardly-extending portion including the slot is located adjacent a longitudinal, threaded through bore receiving the connecting rod, and the vertical through bore is positioned on the opposite side of the bracket from the upwardly-extending portion, and also from the threaded longitudinal bore.

To assemble the hanger, the screwed threaded connecting rod is screwed into the first bracket, and the second bracket is screwed onto the connecting rod and adjusted until the spacing between the first and second brackets corresponds to the width of the flange on which the hanger is to be mounted. The hanger can then be placed upon the upper flange of an I beam and formwork support bolts inserted through the vertical through bores of the brackets. At this time, the support bolts attached to the brackets can, in turn, be attached to formwork. The long support bolt to be angled realtive to the hanger is inserted through the slot and secured by a nut which rests upon the arcuate bearing surface. This bolt may be angled as desired and attached to a supporting strut or other structure.

Accordingly, it is an object of the present invention to provide an adjustable hanger for supporting concrete formwork of the type including a structure that is cantilevered outwardly from an I beam superstructure; a hanger in which the brackets for supporting the formwork support bolts may be varied in spacing to accommodate a variety of I beam flange widths; an adjustable hanger in which the adjustment mechanism provides both ease of adjustability and a positive enagagement between the connecting rod and the brackets; an adjustable hanger in which at least one bracket thereof is capable of supporting a formwork support bolt at a variety of angles relative to the brackets; and a hanger which is compact and can be made relatively inexpensively with loosely-toleranced parts.

Other objects and advantages of the invention will become apparent from the following description, the accompanying drawings, and the appended claims.

DETAILED DESCRIPTION OF THE PREFERRED EMBODIMENT

Figure 2:
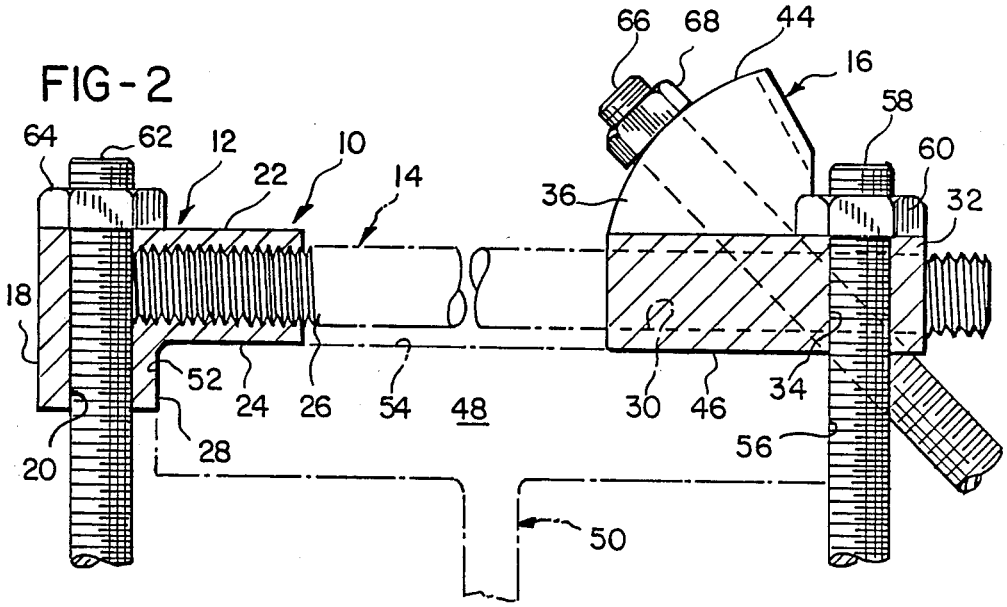
FIG. 2 is a side elevation in section of the adjustable hanger shown in FIG. 1, in which the I beam supporting the hanger is shown in phantom.
Figure 3:
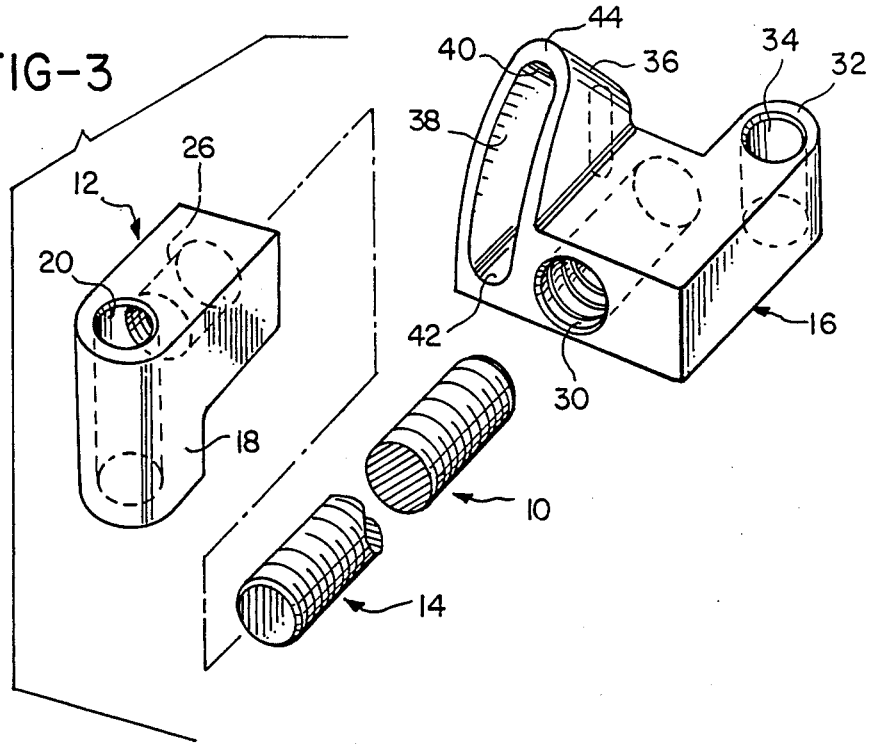
FIG. 3 is an exploded, perspective view of the hanger of FIG. 1.

As shown in FIGS. 2 and 3, the preferred embodiment of the adjustable hanger of the present invention, generally designated 10, includes an inside bracket 12, a connecting rod 14, and an outside bracket 16. The inside bracket 12 is generally L-shaped such that, in use, it provides a downwardly extending portion 18 having a smooth bore 20. The inside bracket 12 also includes a horizontal portion 22 having a flat underside 24 and a threaded bore 26.

The threaded bore 26 is oriented to be perpendicular to the vertical bore 20 ad receive an end of the threaded rod 14. The downwardly extending portion 18 includes a flat inside surface 28 which is perpendicular to the flat underside 24 of the horizontal portion 22, so that the two surfaces 24, 28 form an L-shape for engaging the upper inside edge of an I beam flange.

The outside bracket 16 includes a centrally located, threaded longitudinal through bore 30 for receiving the opposite end of the connecting rod 14. The outside bracket 16 also includes a forwardly extending lobe 32 having a smooth bore 34 therethrough sized to receive a formwork support bolt.

The bracket 16 includes an upwardly-extending wedge-shaped portion 36 on the opposite side of the bore 30 from the lobe 32. The wedge portion 36 includes a wedge-shaped slot 38 having upper and lower walls 40, 42 which converge toward each other in a forward direction. The wedge portion 36 includes an upper arcuate portion 44 which surrounds the upper opening of the slot 38. The entire outside bracket 16 includes a flat underside 46.

As best shown in FIG. 2, the hanger 10 rests upon the upper flange 48 of an I beam 50 such that the inner edge of the flange abuts the flat surface 28 of the downwardly extending portion 18, and the top surface 54 of the flange supports the horizontal surfaces 24, 46 of the inside and outside brackets 12, 16, respectively. More specifically, no portion of the bracket 16 extends below the plane of the flange surface 44 as does the downwardly extending portion 18 of the bracket 12. Typically, the outside bracket 16 is adjusted relative to the connecting rod 14 such that the bore 34 extends beyond the outer edge 56 of the flange 48. This enables a formwork support bolt 58 to be inserted through the bore 34 and retained therein by nut 60. Similarly, the bore 20 of the inside bracket 12 is able to receive a formwork support bolt 62 which is retained within that bore by nut 64.

The wedge portion 36 is capable of receiving a formwork support bolt 66 which is retained within the slot 38 by a nut 68 which engages the arcuate bearing surface 44. When retained within the slot 38 in this manner, the bolt 66 can be pivoted relative to the hanger 10 throughout a range of angles from 0° (parallel to the connecting rod 14) to approximately 45°.

Figure 1:
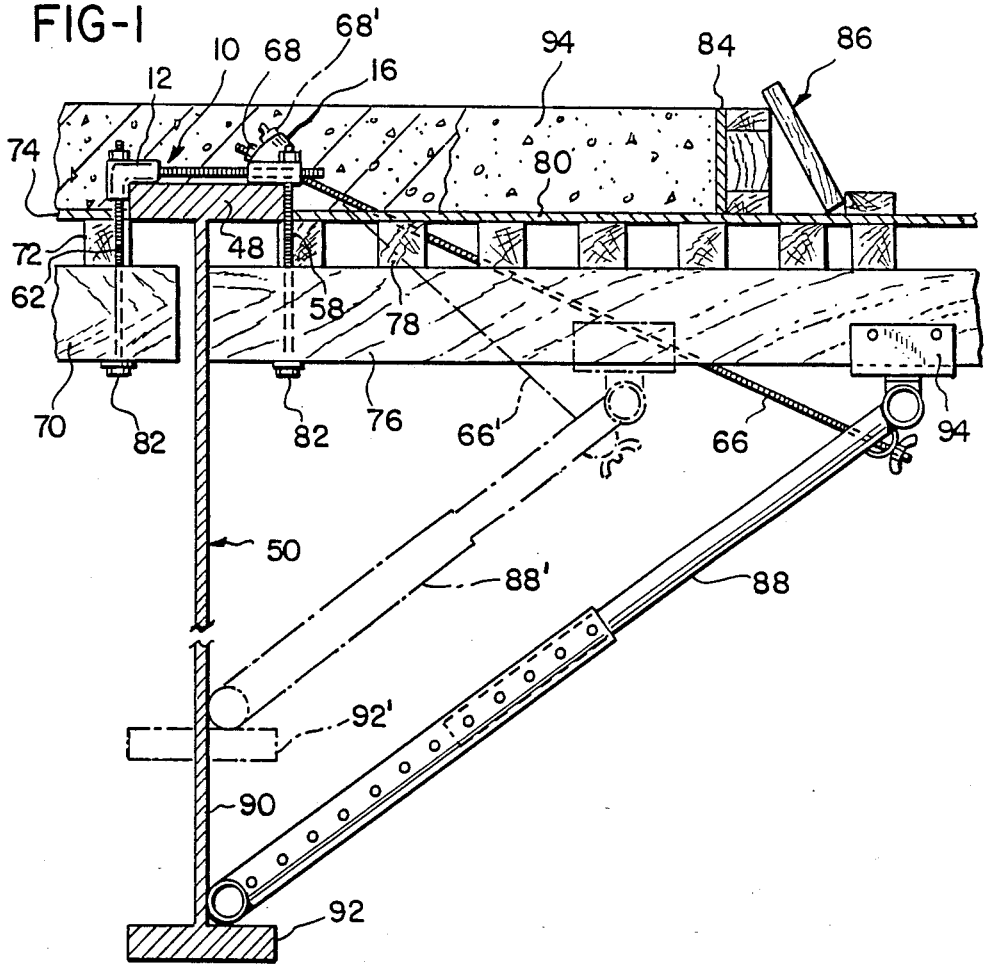
FIG. 1 shows a side elevation of bridge overhang formwork incorporating the adjustable hanger of the present invention.

As shown in FIG. 1, the hanger 10 of the present invention is used to fabricate bridge formwork as follows. After the hanger 10 has been assembled as previously explained and as illustrated in FIG. 2, bolt 62 is attached to the inside bracket 12 and is used to support nominal 3×8 joists 70 which in turn support nominal 4×4 joists 72. Nominal ¾ inch plywood sheets are placed on top of the joists 72 and are flush with the underside of the upper flange 48 of the I beam 50. Similarly, bolt 58 is attached to the outside bracket 16 and is used to support 3×8 joists 76 which in turn support 4×4 joists 78. Plywood sheets 80 are placed on top of the joists 78. The bolts 22, 58 are secured to the joists 70, 76 by nut and washer combinations 82.

The end of the form is defined by a vertical plywood sheet 84 which is held in place by bracing, generally designated 86, that is attached to the plywood sheets 80. The joists 76 are further supported by the bolt 66 which extends through the plywood sheets 80 and retains the upper end of a jack 88. The lower end of the jack 88 is wedged against the web 90 and lower flange 92 of the I beam 50. The upper end of the jack 88 is attached by a bracket 94 to the underside of the joists 76. It should be noted that the hanger 10 can be used with different sized wooden, steel, or aluminum members of sufficient strength, rather than wood joists 70, 72.

Should the hanger 10 be used with a different size I beam, for example one having a bottom flange shown in phantom and designed 92' in FIG. 1, the jack 88 would have to be collapsed to the configuration shown as 88' in FIG. 1, requiring the bolt 66 to be pivoted to the position indicated as 66'.

This modification can be accomplished easily by pivoting the bolt 66 relative to the hanger 10, which causes the nut 68 to move from the position shown in FIG. 1 to the position indicated as 68' since the wedge portion 36 includes an arcuate bearing surface 44, the nut 68 is adequately supported at both positions, and additional components, such as spherical bearings, are not required to make a secure fit.

After the formwork is erected as shown in FIG. 1, concrete 94 is poured and hardens, encasing the hanger 10. The protruding portions of the bolts and the formwork are then removed, and the resultant holes are filled with a grout mixture.

The entire hanger 10 preferably is fabricated from mild steel, however, some applications may require high strength steel. The inside and outside brackets 12, 16 may be sand cast.

While the form of apparatus herein described constitute a preferred embodiment of this invention, it is to be understood that the invention is not limited to this precise form of apparatus, and that changes may be made therein without departing from the scope of the invention.

What is claimed is:

1. An adjustable hanger assembly for supporting concrete forms from the top flange of an I-beam of a range of different widths, comprising:

(a) a first bracket having thereon a flat surface for engaging the top face of the flange and having also a portion extending downwardly below said surface for engaging one edge of the flange, (b) said bracket having a first bore extending through said downwardly extending portion thereof at right angles to said flat surface for receiving a vertically extending form-supporting bolt therethrough, (c) said bracket having also an internally threaded bore extending parallel with said flat surface, (d) a second bracket including a flat surface for engaging the top of the I-beam flange and having an opening extending therethrough at an angle to said flat surface and in a plane perpendicular to said flat surface for receiving a downwardly-extending form-supporting bolt therethrough (e) all of said second bracket being located above the plane defined by said flat surface thereon whereby no portion of said second bracket can engage an edge of the I-beam flange, (f) said second bracket also having an internally threaded bore extending entirely therethrough parallel with the above said flat surface, (g) a threaded rod having one end received in threaded relation in said threaded bore in said first bracket and having the other end thereof received in threaded relation in said threaded bore in said second bracket, (h) said opening being in the form of a slot providing for angular adjustment of said form-supporting bolt in a vertical plane parallel with said threaded rod, (i) said second bracket also including a bore extending therethrough at right angles to said flat surface thereon for receiving a vertically extending form-supporting bolt therethrough in addition to said angularly extending bolt, (j) said rod constituting the sole connection between said brackets whereby the relative spacing of said brackets on said rod is adjustable in accordance with the width of the I-beam flange by relative movement of one of said brackets and said rod, and said rod absorbs both the tension and the compression loads applied to said assembly in use, and (k) said slot and the second named said bore in said second bracket being laterally offset on opposite sides of said threaded bore in said second bracket whereby said threaded bolt can be threaded entirely through and beyond said second bracket without contact with a bolt extending through said opening through said second bracket.

2. A hanger assembly as defined in claim 1 wherein said second bracket includes wall portions forming the opposed sides of said slot, and the upper surfaces of said wall portions are convexly curved to form bearing surfaces for a nut on the upper end of said form-supporting bolt extending through said slot to facilitate said angular adjustment of said bolt.

* * * * *